US006768464B1

(12) United States Patent
Shoji et al.

(10) Patent No.: US 6,768,464 B1
(45) Date of Patent: Jul. 27, 2004

(54) ANTENNA ELEMENT AND PORTABLE INFORMATION TERMINAL

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/030,113

(22) PCT Filed: Jun. 1, 2000

(86) PCT No.: PCT/JP00/03528

§ 371 (c)(1),
(2), (4) Date: Jan. 23, 2002

(87) PCT Pub. No.: WO01/93368

PCT Pub. Date: Dec. 6, 2001

(51) Int. Cl.[7] ..... H01Q 1/27

(52) U.S. Cl. ..... 343/702; 343/700 MS; 343/873; 343/895

(58) Field of Search ..... 343/700 MS, 702, 343/873, 895, 893, 896, 900

(56) References Cited

U.S. PATENT DOCUMENTS 6,137,445 A * 10/2000 Ha et al. ..... 343/702
6,198,441 B1 * 3/2001 Okabe et al. ..... 343/702
6,211,830 B1 * 4/2001 Monma et al. ..... 343/702
6,326,924 B1 * 12/2001 Muramoto et al. ..... 343/702
6,388,626 B1 * 5/2002 Gamalielsson et al. ..... 343/702

FOREIGN PATENT DOCUMENTS

| | | |
|---|---|---|
| JP | 6-152221 | 5/1994 |
| JP | 6-291711 | 10/1994 |
| JP | 7-38316 | 2/1995 |
| JP | 7-273688 | 10/1995 |
| JP | 7-283631 | 10/1995 |
| JP | 9-18215 | 1/1997 |
| JP | 3048535 | 5/1998 |
| JP | 10-173422 | 6/1998 |
| JP | 11-205037 | 7/1999 |
| JP | 11-274828 | 10/1999 |

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

A portable telephone including a main unit case and an antenna element. The antenna element includes a meander line antenna as the first antenna unit arranged within the main unit case and formed to extend in one direction, and a second antenna unit extending substantially orthogonal to the extending direction of the meander line antenna, and arranged projectable from the main unit case, having an electrical length of approximately (λ/2)×A (A is an integer), and coupled to the meander line antenna.

8 Claims, 16 Drawing Sheets

ANTENNA ELEMENT AND PORTABLE INFORMATION TERMINAL

TECHNICAL FIELD

The present invention relates to an antenna element and a portable information terminal, particularly to an antenna element used in a portable telephone and a portable telephone employing such an antenna element.

BACKGROUND ART

As conventional antenna elements for the transmission and reception in a portable telephone, the monopole antenna and helical antenna attached so as to extend in the longitudinal direction of a casing are known.

The impedance of such antenna elements differs from the impedance of the radio transmitter-receiver in the portable telephone. Therefore, the impedance must be matched. A matching circuit to match the impedance is provided between the radio transmitter-receiver and the antenna element in the conventional portable telephone.

The matching circuit is configured by a lumped constant element such as coils and capacitors. When electric signals are transmitted from the radio transmitter-receiver to the antenna element via the matching circuit, there was a problem that a loss is generated in the coil and capacitor in the matching circuit to result in degradation of the transmission efficiency of the electric signal.

In electrical communication such as of a portable telephone, a vertically polarized wave is used as the wave to transmit information. This is due to the fact that the wave diffraction effect is great in vertical polarization. The wave can travel around a construction to arrive at the backside thereof so that a wave can be transmitted/received even to/from an area blocked by a construction.

Although the antenna element of a portable telephone is designed so as to extend substantially perpendicular in a conversation mode since a vertically polarized wave is transmitted/received as the main wave of polarization, it is known that the portable telephone terminal is generally tilted 60° on an average to the zenith angle when used. Accordingly, there is the problem that the main wave of polarization is reversed to become a horizontally polarized wave during actual conversation.

It is therefore difficult to transmit/receive a vertically polarized wave in the practical application of a conversation mode through an antenna element that extends only in the perpendicular direction. It is particularly difficult to transmit/receive a vertically polarized wave in practical conversation when an antenna element having an electrical length which is an integer multiple of $\lambda/2$ is used. Thus, the conventional antenna element imposes a problem that the gain in conversation is low since it is difficult to transmit/receive a vertically polarized wave during conversation in practice.

The present invention is directed-to solve such a problem.

An object of the present invention is to provide an antenna element and portable information terminal reduced in electrical signal loss and with high efficiency.

Another object of the present invention is to provide an antenna element and portable information terminal of high gain in conversation.

DISCLOSURE OF THE INVENTION

An antenna element according to the present invention includes a first antenna unit formed to extend in one direction, and a second antenna unit having an electrical length of substantially $(\lambda/2)\times A$ (A is an integer), coupled to the first antenna unit and extending in a direction substantially orthogonal to the extending direction of the first antenna unit.

In the antenna element thus configured, the first antenna unit functions as the conventional matching circuit. Since this first antenna unit can be configured without using a lumped constant element, no loss is generated here. Therefore, the antenna efficiency can be improved. Since the second antenna unit extends substantially orthogonal to the extending direction of the first antenna element, any one of the first and second antenna units can transmit/receive a vertically polarized wave whereas the other can transmit/receive a horizontally polarized wave. Accordingly, a vertically polarized wave and a horizontally polarized wave can be transmitted/received regardless of the orientation of the antenna element. Thus, the antenna element has the gain in a conversation mode improved.

Preferably, the electrical length of the first antenna unit is approximately $(\lambda/4)+(\lambda/2)\times B$ (B is an integer). In this case, the first antenna unit is equal to the so-called $\lambda/4$ antenna to reliably transmit/receive a vertically or horizontally polarized wave at the first antenna unit.

Preferably, the first antenna unit includes at least one type of antenna selected from the group consisting of a plate antenna, a monopole antenna, a helical antenna, a meander line antenna and a zigzag antenna.

Also preferably, the second antenna unit includes a line antenna.

Also preferably, the line antenna includes at least one type of antenna selected from the group consisting of a monopole antenna and a helical antenna.

Further preferably, the antenna element further includes a substrate having a conductive surface. The first antenna unit is provided on the surface of the substrate with a dielectric therebetween. The second antenna unit is provided so as to extend from the substrate.

Since the first antenna unit is provided on the substrate with a dielectric therebetween here, the wavelength of the electromagnetic wave progressing the first antenna unit can be reduced. As a result, the length of the first antenna unit can be reduced to allow a smaller antenna element. Since the second antenna unit is provided so as to extend from the substrate, a wave can be transmitted/received reliably without the second antenna unit being affected by the substrate.

Also preferably, the first antenna unit and the second antenna unit are attached in order to a feeding point.

A portable information terminal according to the present invention includes a main unit case and an antenna element. The antenna element includes a first antenna unit disposed in the main unit case and extending in one direction, and a second antenna unit arranged projectable from the main unit case, having an electrical length of approximately $(\lambda/2)\times A$ (A is an integer) coupled to the first antenna unit and extending substantially orthogonal to the extending direction of the first antenna unit.

In the portable information terminal thus configured, the first antenna unit functions to match the impedance between the second antenna unit and a radio transmitter-receiver unit. Since the first antenna unit can be configured without using a lumped constant element, any loss at this region can be prevented. Since the second antenna unit extends in a direction substantially orthogonal to a first antenna unit, any one of the first antenna unit and the second antenna unit can receive/transmit a vertically polarized wave whereas the other can transmit/receive a horizontally polarized wave irrespective of the orientation of the portable telephone. As a result, a portable information terminal of a high gain in a conversation mode is provided.

Further preferably, the second antenna unit includes a third antenna unit having an electrical length of approximately $(\lambda/2)\times C$ (C is an integer), and a fourth antenna unit coupled to the third antenna unit and having an electrical length of approximately $(\lambda/2)\times D$ (D is an integer). When the antenna element is pulled out from the main unit case, the third and fourth antenna units project from the main unit case. When the antenna element is stored in the main unit case, the third antenna unit projects from the main unit case whereas the fourth antenna unit is located in the main unit case.

In the case where the antenna element is pulled out from the portable information terminal configured as described above, the third antenna unit having an electrical length of approximately $(\lambda/2)\times C$ and the fourth antenna unit having an electrical length of approximately $(\lambda/2)\times D$ project from the main unit case. Therefore, the electrical length of the projecting antenna is equal to an integer multiple of $\lambda/2$. Accordingly, a wave can be reliably transmitted/received by this antenna. Since the third antenna unit having an electrical length of approximately $(\lambda/2)\times C$ projects from the main case even when the antenna element is in an accommodated state, a wave can be reliably transmitted/received by the antenna.

BEST MODES FOR CARRYING OUT THE INVENTION

Embodiments of the present invention will be described hereinafter with reference to the drawings.

First Embodiment

Figure 1:
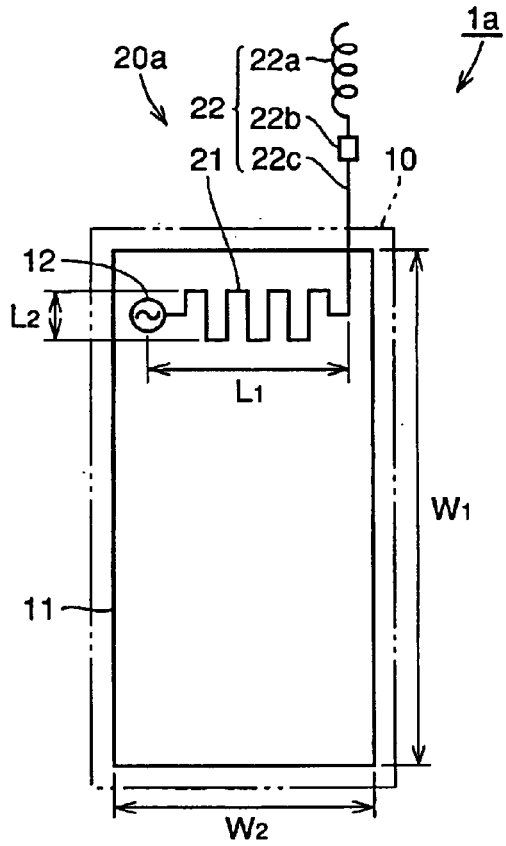
FIG. 1 shows a portable telephone according to a first embodiment of the present invention with the antenna in a pulled out state.

FIG. 1 shows a portable telephone according to a first embodiment of the present invention with the antenna pulled out. Referring to FIG. 1, a portable telephone 1*a* includes a main unit case 10 and an antenna element 20*a*. Antenna element 20*a* includes a meander line antenna 21 which is the first antenna unit, formed to extend in one direction, a second antenna unit 22 with an electrical length of approximately $(\lambda/2)\times A$ (A is an integer), coupled to meander line antenna 21, and extending substantially orthogonal to the extending direction of meander line antenna 21, and a metal substrate 11 serving as a substrate supporting meander line antenna 21 and second antenna unit 22.

Metal substrate 11 is formed having a metal of high conductivity such as copper deposited on a predetermined insulation substrate. The metal formed on the insulation substrate may be replaced with another that has a conductivity similar to that of copper. Metal substrate 11 extends in the longitudinal direction, and is substantially rectangle in shape. Second antenna unit 22 is provided so as to extend along the longer side of metal substrate 11. Meander line antenna 21 is provided so as to extend along the shorter side of metal substrate 11. Metal substrate 11 is disposed in main unit case 10 of the portable telephone.

Metal substrate 11 is of a thin plate configuration with a radio transmitter-receiver not shown provided at the surface. The radio transmitter-receiver is connected to meander line antenna 21 via a feeding point 12.

Meander line antenna 21 which is the first antenna unit is provided in the direction of the shorter side of metal substrate 11, i.e., in the direction from left to right in FIG. 1. An airspace is provided between meander line antenna 21 and the surface of metal substrate 11. A solid dielectric may be provided between meander line antenna 21 and metal substrate 11 to hold meander line antenna 21. Meander line antenna 21 has one end connected to feeding point 21 and the other end connected to second antenna unit 22. The electrical length of meander line antenna 21 is $\lambda/4$. The electrical length of meander line 21 can be also set to $(\lambda/4)+(\lambda/2)\times B$ (B is an integer).

Second antenna unit 22 is provided so as to be connected to meander line antenna 21. Second antenna unit 22 includes a helical antenna 22*a*, an insulator 22*b* and a monopole antenna 22*c*. Helical antenna 22*a* and monopole antenna 22*c* are line antennas with insulator 22*b* therebetween. Insulator 22*b* is formed of, for example, ABS (alkyl benzene sulfonic acid) resin. Helical antenna 22*a* constitutes the third antenna, and has an electrical length of λ/2. The electrical length of helical antenna 22*a* can be set to (λ/2)×C (C is an integer). Monopole antenna 22*c* constitutes the fourth antenna unit, and has an electrical length of λ/2. The electrical length of monopole antenna 22*c* can be also set to (λ/2)×D (D is an integer).

In the state where the antenna of FIG. 1 is pulled out, helical antenna 22*a* and monopole antenna 22*c* project from main unit case 10. Meander line antenna 21 is accommodated in main unit case 10.

Meander line antenna 21 and second antenna unit 22 extend substantially orthogonal to form an L shape antenna. Meander line antenna 21 functions to match the impedance between second antenna unit 22 and a radio transmitter-receiver not shown connected to feeding point 12. In the state where the user holds the portable telephone over his/her ear, second antenna unit 22 extends in a direction that is substantially perpendicular whereas the first antenna unit extends in a direction that is substantially horizontal.

Figure 2:
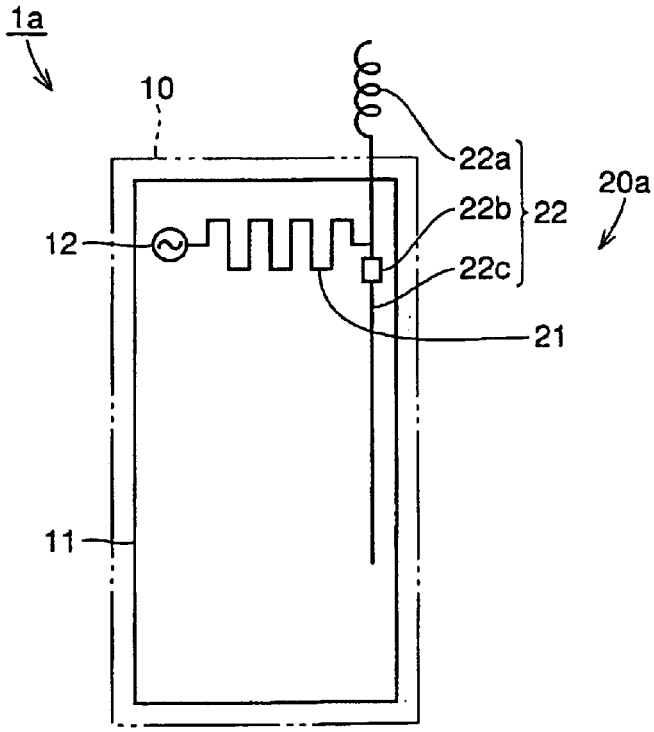
FIG. 2 shows a portable telephone according to the first embodiment of the present invention with the antenna in an accommodated state.

FIG. 2 shows the state where the antenna is stored in the portable telephone of the first embodiment. Referring to FIG. 2, monopole antenna 22*c* and insulator 22*b* are located in main unit case 10 when the antenna is in an accommodated state. In contrast, helical antenna 22*a* is configured so as to project from main unit case 10. Here, helical antenna 22*a* functions as the so-called λ/2 antenna.

According to portable telephone 1*a* and antenna element 20*a* of the above-described structure, a matching circuit formed of a lumped constant element is not required. Therefore, any occurrence of a loss in the lumped constant element can be prevented. Thus, a portable telephone and antenna element of high efficiency can be provided.

Second antenna unit 22 extends in a direction orthogonal to meander line antenna 21. Therefore, when portable telephone 1*a* is held so that second antenna unit 22 extends in the perpendicular direction, second antenna unit 22 transmits/receives a vertically polarized wave whereas meander line antenna 21 transmits/receives a horizontally polarized wave. In contrast, when portable telephone 1*a* is held so that second antenna unit 22 extends in the horizontal direction, second antenna unit 22 transmits/receives a horizontally polarized wave whereas meander line antenna 21 transmits/receives a vertically polarized wave. Since a vertically polarized wave and horizontally polarized wave can be transmitted/received irrespective of the orientation of portable telephone 1*a*, the gain in a conversation mode can be improved.

In either case where the antenna is pulled out or accommodated as shown in FIGS. 1 and 2, the antenna having an electrical length of λ/2 projects. Therefore, a wave can be transmitted/received through this antenna in either case where the antenna is pulled out or accommodated.

Second Embodiment

Figure 3:
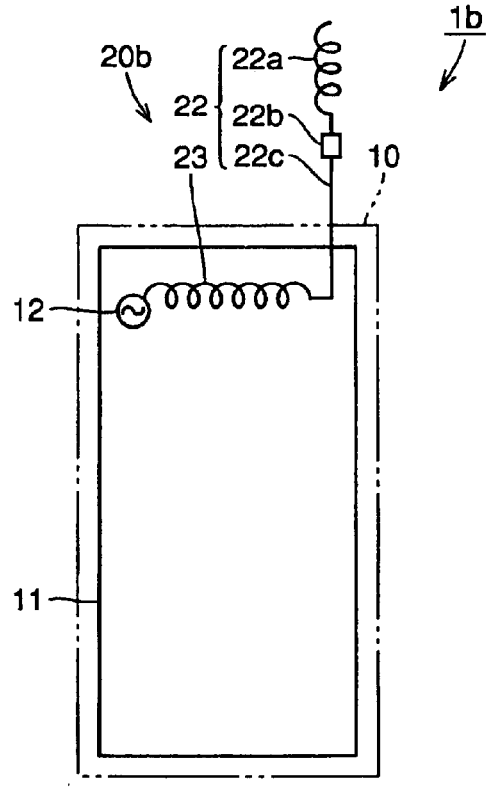
FIG. 3 shows a portable telephone according to a second embodiment of the present invention.

FIG. 3 shows a portable telephone according to a second embodiment of the present invention. Referring to FIG. 3, a portable telephone 1*b* according to the second embodiment includes an antenna element 20*b*. Antenna element 20*b* differs from antenna element 20*a* shown in FIGS. 1 and 2 in that the first antenna unit is formed of a helical antenna 23. Helical antenna 23 has an electrical length of approximately (λ/4)+(λ/2)×B (B is an integer).

Portable telephone 1*b* and antenna element 20*b* configured as described above provides advantageous effects similar to those of portable telephone 1*a* and antenna element 20*a* of FIGS. 1 and 2 of the first embodiment. Since the physical length of the first antenna can be reduced by using helical antenna 23 as the first antenna unit, portable telephone 1*b* can be reduced in size.

Third Embodiment

Figure 4:
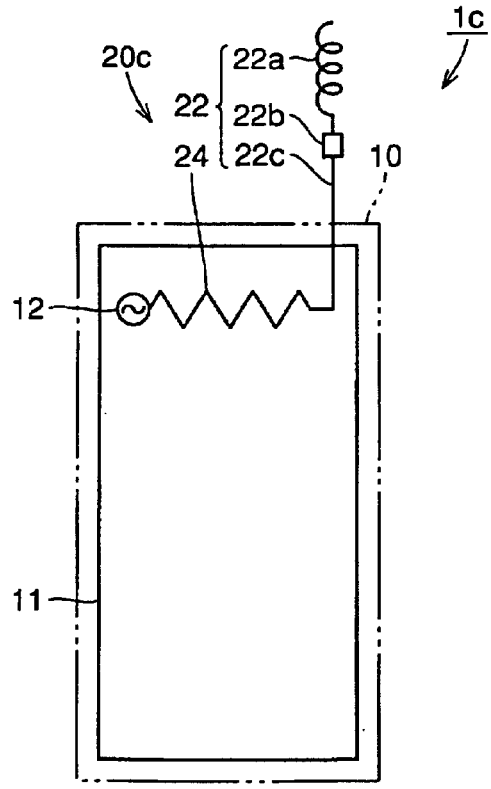
FIG. 4 shows a portable telephone according to a third embodiment of the present invention.

FIG. 4 shows a portable telephone according to a third embodiment of the present invention. Referring to FIG. 4, portable telephone 1*c* of the third embodiment has an antenna element 20*c*. Antenna element 20*c* differs from antenna element 20*a* of FIGS. 1 and 2 in that the first antenna unit is formed of a zigzag antenna 24. The electrical length of zigzag antenna 24 is approximately (λ/4)+(λ/2)×B (B is an integer).

Portable telephone 1*c* and antenna element 20*c* configured as described above provide advantageous effects similar to those of portable telephone 1*a* and antenna element 20*a* of the first embodiment.

Fourth Embodiment

Figure 5:
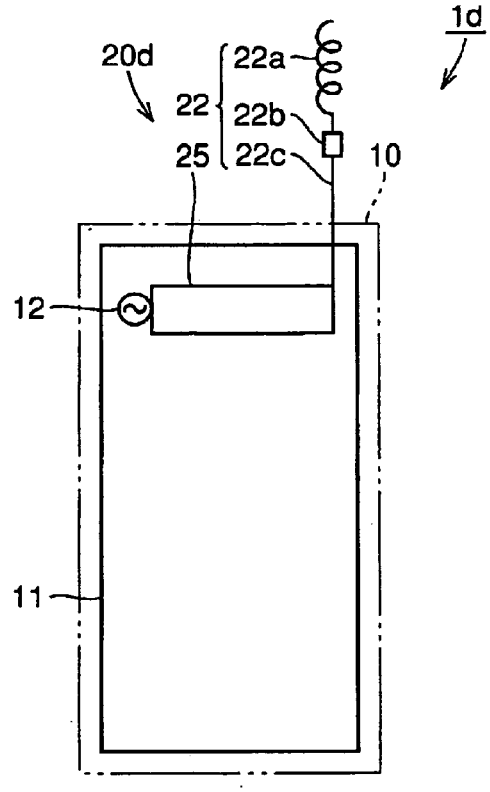
FIG. 5 shows a portable telephone according to a fourth embodiment of the present invention.

FIG. 5 shows a portable telephone according to a fourth embodiment of the present invention. Referring to FIG. 5, a portable telephone 1*d* of the fourth embodiment includes an antenna element 20*d*. Antenna element 20*d* differs from antenna element 20*a* of FIGS. 1 and 2 in that the first antenna unit is formed of a plate antenna 25. Plate antenna 25*a* is formed to have a short side that extends along second antenna unit 22, and a long side. The long side is formed to extend in a direction substantially orthogonal to second antenna unit 22. The electrical length of plate antenna 25 is approximately (λ/4)+(λ/2)×B (B is an integer).

Portable telephone 1*d* and antenna element 20*d* configured as described above provide advantageous effects similar to those of portable telephone 1*a* and antenna element 20*a* of FIGS. 1 and 2. Furthermore, by using plate antenna 25 as the first antenna unit, the current flow in the first antenna unit can be deconcentrated. Accordingly, degradation in the gain of the first antenna can be prevented.

Fifth Embodiment

Figure 6:
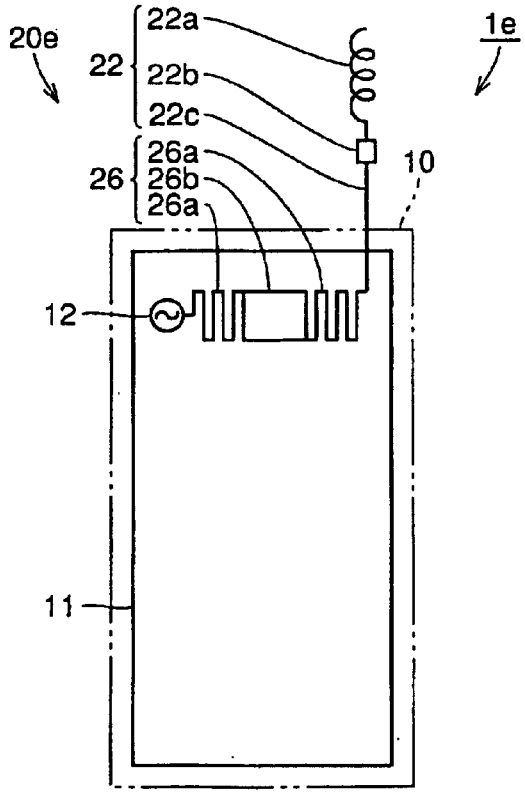
FIG. 6 shows a portable telephone according to a fifth embodiment of the present invention.

FIG. 6 shows a portable telephone according to a fifth embodiment of the present invention. Referring to FIG. 6, a portable telephone 1*e* of the fifth embodiment includes an antenna unit 20*e*. Antenna unit 20*e* includes a first antenna unit 26. The difference from antenna element 20*a* of FIGS. 1 and 2 lies in that first antenna element 26 is formed of a meander line antenna 26*a* and a plate antenna 26*b*. Meander line antenna 26*a* is disposed at both ends of first antenna unit 26. Plate antenna 26*b* is located substantially at the center between meander line antennas 26*a*. The electrical length of first antenna unit 26 is approximately (λ/4)+(λ/2)×B (B is an integer).

Portable telephone 1*e* and antenna element 20*e* configured as described above provide advantageous effects similar to those of portable telephone 1*a* and antenna element 20*a* of FIGS. 1 and 2 of the first embodiment. Furthermore, by disposing plate antenna 26*b* at the center of first antenna unit 26 exhibiting the greatest current distribution, degradation of the gain when one's finger is placed on first antenna unit 26 can be reduced.

Sixth Embodiment

Figure 7:
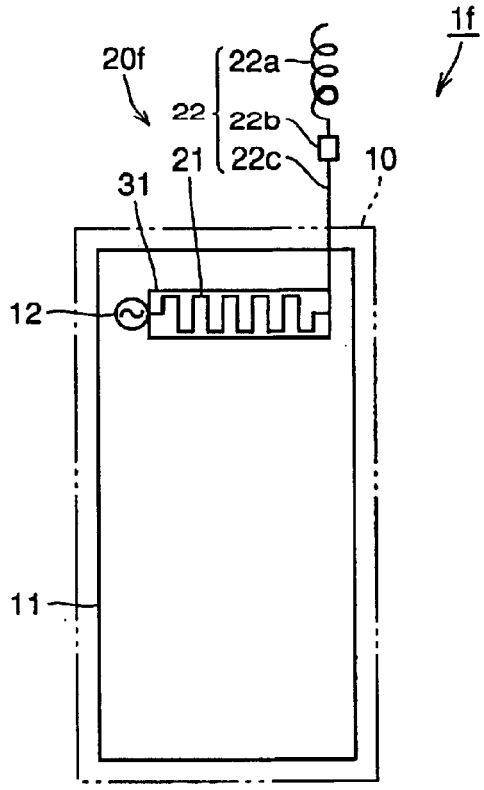
FIG. 7 shows a portable telephone according to a sixth embodiment of the present invention.

FIG. 7 shows a portable telephone according to a sixth embodiment of the present invention. Referring to FIG. 7, a portable telephone 1*f* according to the sixth embodiment of the present invention includes an antenna element 20*f*. A meander line antenna 21 which is the first antenna unit of antenna element 20*f* is disposed on a dielectric 31. Dielectric 31 is formed of a material having a small dielectric dissipation factor (tan δ) and a high relative dielectric constant. For example, dielectric 31 is formed of a ceramics type material (relative dielectric constant≈7–100), Teflon (relative dielectric constant≈2.1) and a resin based material (relative dielectric constant≈3.3) such as Vectra. Although meander line antenna 21 is provided on and along dielectric 31, meander line antenna 21 can be embedded in dielectric 31 instead. Furthermore, on dielectric 31 may be disposed helical antenna 23 of FIG. 3, zigzag antenna 24 of FIG. 4, plate antenna 25 of FIG. 5, and first antenna unit 26 of FIG. 6 having meander line antenna 26*a* and plate antenna 26*b* coupled.

Portable telephone 1*f* and antenna element 20*f* configured as described above provide advantageous effects similar to those of portable telephone 1*a* and antenna element 20*a* shown in FIGS. 1 and 2. Since meander line antenna 21 is mounted on dielectric 31 that has a high relative dielectric constant, the wavelength of the wave progressing meander line antenna 21 can be reduced. As a result, the size of meander line antenna 21 can be reduced. Accordingly, metal substrate 11 can be reduced in size, which in turn allows main unit case 10 configuring portable telephone if to be reduced in size.

Seventh Embodiment

Figure 8:
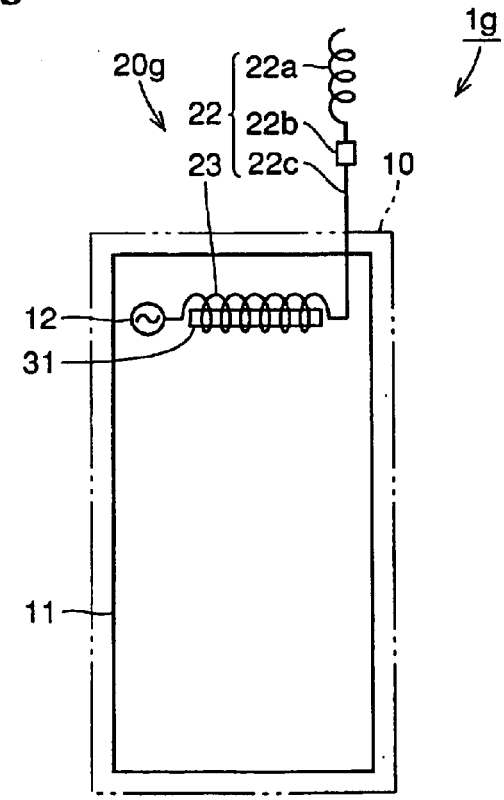
FIG. 8 shows a portable telephone according to a seventh embodiment of the present invention.

FIG. 8 shows a portable telephone according to a seventh embodiment of the present invention. Referring to FIG. 8, a portable telephone 1*g*according to the seventh embodiment includes an antenna element 20*g*. Antenna element 20*g* has dielectric 31 disposed in helical antenna 23 which is the first antenna unit. Dielectric 31 is disposed in a core-like manner at the center of helical antenna 23 forming a coil. Dielectric 31 extends along the extending direction of helical antenna 23. The material forming dielectric 31 may be identical to that forming dielectric 31 of FIG. 7.

Portable telephone 1*g* and antenna element 20*g* configured as described above provide advantageous effects similar to those of portable telephone 1*f* and antenna element 20*f* of FIG. 7.

Eighth Embodiment

Figure 9:
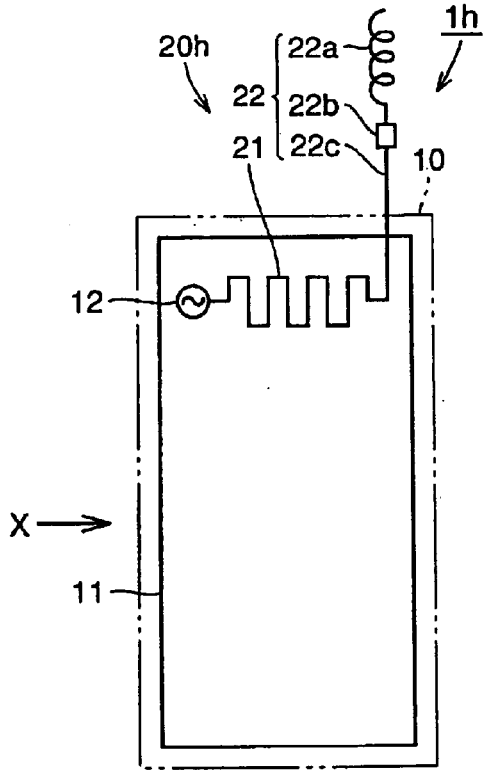
FIG. 9 shows a portable telephone according to an eighth embodiment of the present invention.
Figure 10:
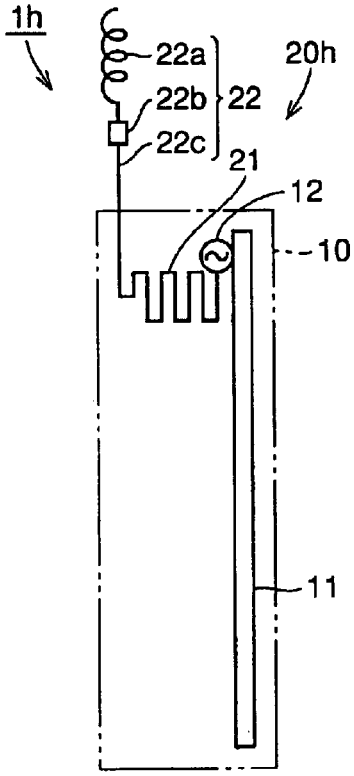
FIG. 10 shows a portable telephone when viewed from the direction indicated by arrow X of FIG. 9.

FIG. 9 shows a portable telephone according to an eighth embodiment of the present invention. FIG. 10 is a diagram of the portable telephone viewed from the direction indicated by arrow X in FIG. 9. Referring to FIG. 9, a portable telephone 1*h* includes an antenna element 20*h*. Antenna element 20*h* includes a meander line antenna 21 as the first antenna unit. Meander line antenna 21 is located close to the surface of metal substrate 11 in the proximity of feeding point 12, and extends in a direction away from metal substrate 11 as a function of distance from feeding point 12. In other words, the distance between metal substrate 11 and meander line antenna 21 is relatively small in the proximity of feeding point 12 and relatively great at the area where meander line antenna 21 is connected to monopole antenna 22*c*. Thus, meander line antenna 21 is formed to extend in a direction farther away from metal substrate 11.

Referring to FIG. 10, a feeding point 12 is provided at the surface of metal substrate 11. Meander line antenna 21 is provided so as to be connected to feeding point 12. Meander line antenna 21 has one end connected to feeding point 12 and the other end connected to monopole antenna 22*c*. Meander line antenna 21 extends in a direction farther away from the surface of metal substrate 11. Monopole antenna 22*c* provided at an end of meander line antenna 21 is formed to extend perpendicular to meander line antenna 21. The distance between monopole antenna 20*c* and metal substrate 11 is greater than the distance between monopole antenna 22*c* and metal substrate 11 shown in FIGS. 1 and 2. In other words, in antenna element 20*h* of the eighth embodiment, the distance between metal substrate 11 and second antenna unit 22 becomes relatively larger.

Portable telephone 1*h* and antenna element 20*h* configured as described above provide advantageous effects similar to those of portable telephone 1*a* and antenna element 20*a* shown in FIGS. 1 and 2. Since meander line antenna 21 is bent in a three-dimensional manner, the gain can be improved regardless of the orientation of portable telephone 1*h*.

Specific examples of the present invention will be described hereinafter.

In an antenna element 20*a* of the present invention as shown in FIG. 1, the length of the longer side $W_1$ and the length of the shorter side $W_2$ of metal substrate 11 were set to 0.85 λ and 0.2 λ, respectively. Meander line antenna 21 had the length $L_1$ in the horizontal direction set to 0.15 λ and the length $L_2$ in the vertical direction set to 0.05 λ. Accordingly, the electrical length of meander line antenna 21 was 0.25 λ. The electrical length of monopole antenna 22*c* was set to λ/2 and the electrical length of helical antenna 22*a* was set to λ/2. Waves of 1.5 GHz to 2.5 GHz in frequency were caused to be incident on feeding point 12 of the above-described sample. The impedance characteristics (Smith chart and VSWR) of antenna element 20*a* were identified. The impedance and VSWR for respective points are shown in the following Table 1.

TABLE 1

| | | Impedance of Antenna Element (Ω) | | |
|---|---|---|---|---|
| Point | Frequency (GHz) | Real Part (Ω) | Imaginary Part (Ω) | VSWR |
| 101 | 1.92 | 40.7 | −35.4 | 2.2 |
| 102 | 1.98 | 37.2 | −22.1 | 1.8 |
| 103 | 2.11 | 35.3 | 22.9 | 1.9 |
| 104 | 2.17 | 33.9 | 35.8 | 2.5 |

Figure 11:
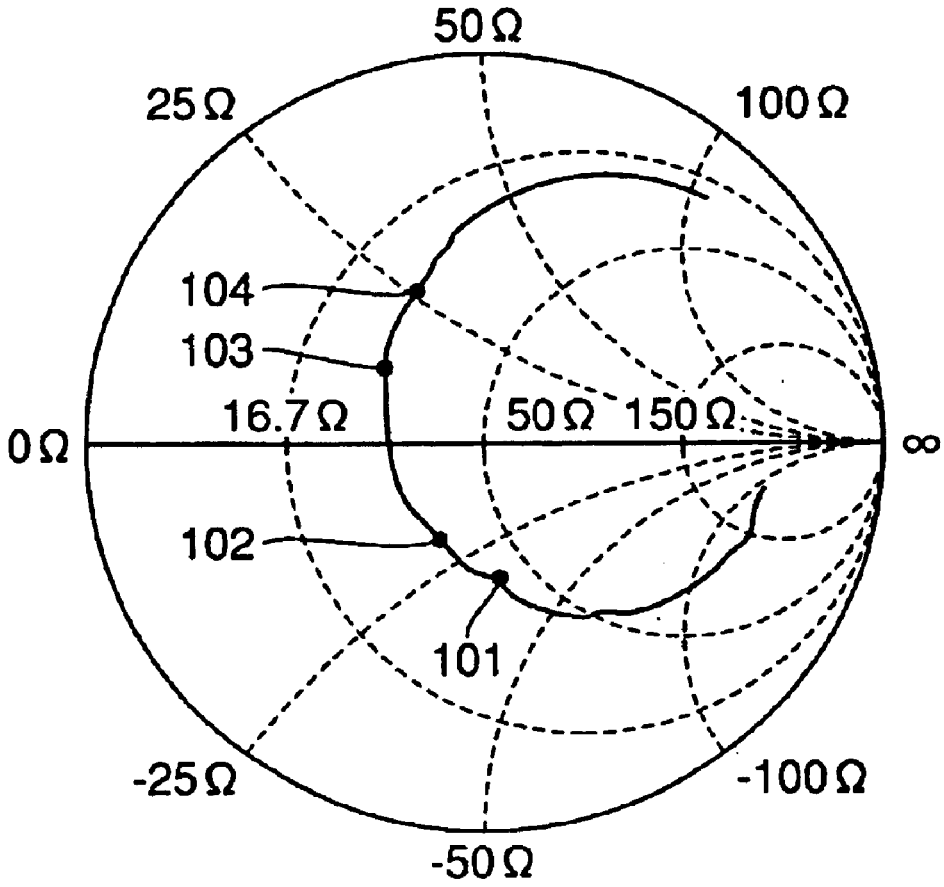
FIG. 11 is a Smith chart to describe the property of the antenna element of the present invention.
Figure 12:
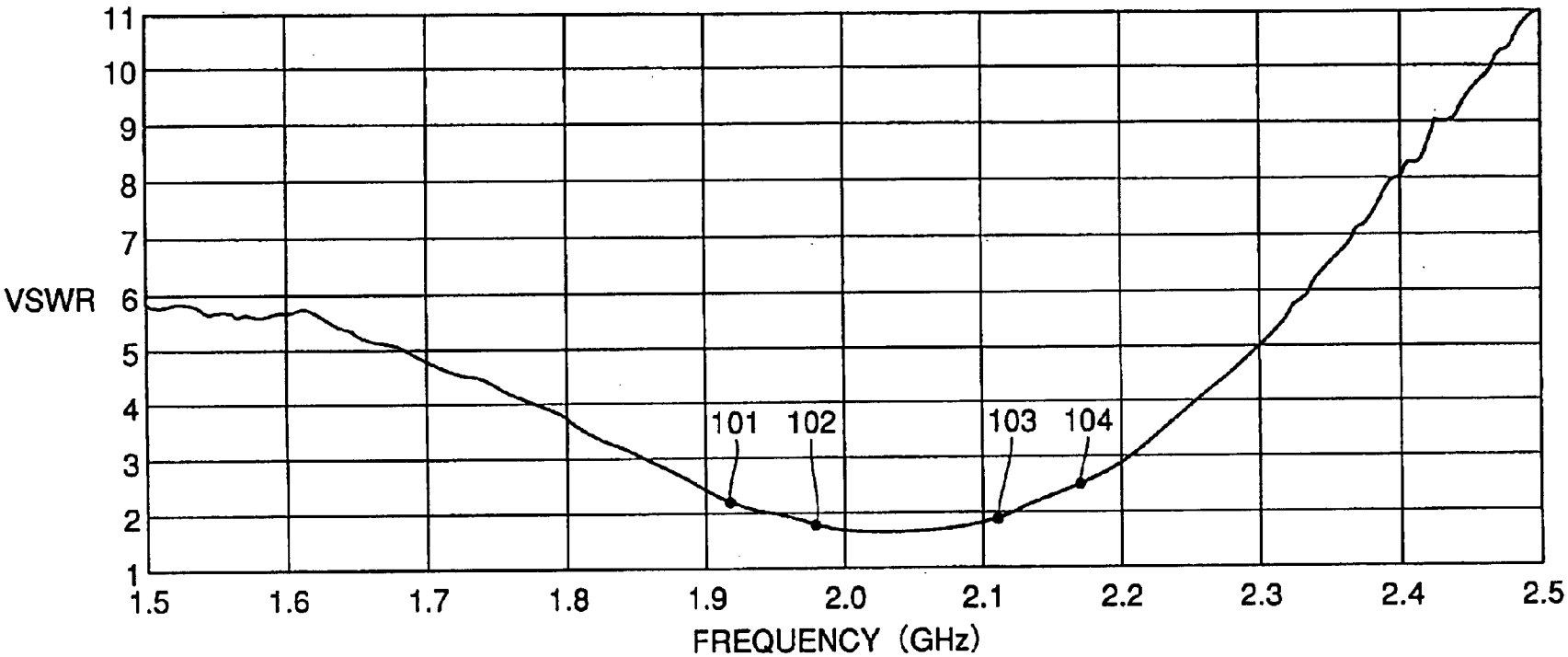
FIG. 12 is a graph indicating the relationship between the frequency and VSWR (Voltage Standing Wave Ratio) of the antenna element of the present invention.

The Smith chart is shown in FIG. 11. The relationship between the VSWR and frequency is shown in FIG. 12. It is appreciated from the Smith chart of FIG. 11 that in the antenna element of the present invention, the locus of the impedance is concentrated in the proximity of the center point of the Smith chart and that the reflection coefficient is small. It is particularly appreciated that the reflection coefficient at the regions of points 101–104 is particularly small since points 101–104 are located in the proximity of the center point. Also, it is appreciated from FIG. 12 that the region where the VSWR is below 2 is the region where the frequency is at least 1.95 GHz and not more than 2.12 GHz. The relative bandwidth is 3.4%. In the present specification, "relative bandwidth" refers to the relative bandwidth for the region where the VSWR is 2 or below. The relative bandwidth is obtained by the following equation.

Relative bandwidth=(the highest frequency where VSWR is 2—the lowest frequency where VSWR is 2)/2.0 GHz The reason why the property of the antenna is evaluated at the region where the VSWR is below 2 may be due to the fact that, when information communication is effected at a certain frequency (bandwidth), the antenna is designed so that the VSWR at that bandwidth is not more than 2.

Figure 13:
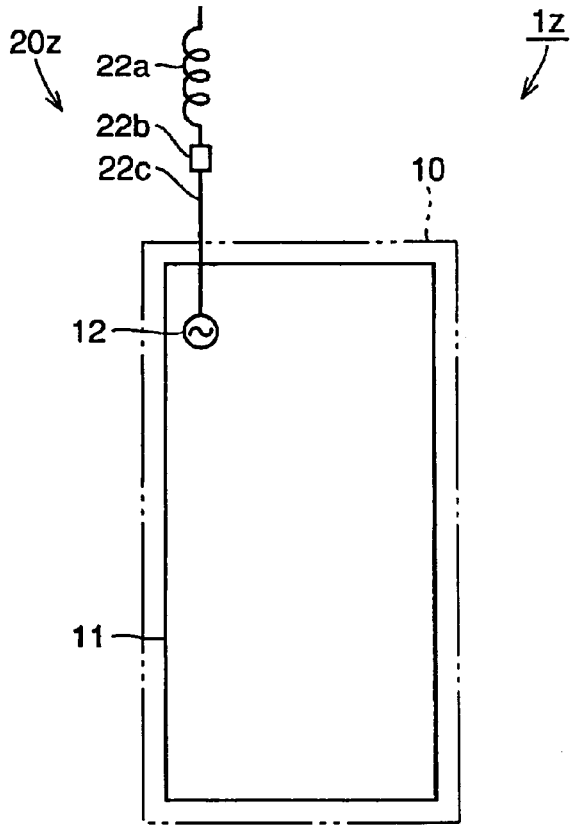
FIG. 13 PRIOR ART
FIG. 13 shows a conventional portable telephone.

The Smith chart and the relationship between the frequency and VSWR has been studied for a conventional product. FIG. 13 shows a conventional portable telephone. Referring to FIG. 13, the conventional portable telephone differs from the portable telephone of the present invention shown in FIG. 1 in that meander line antenna 21 is absent. Specifically, feeding point 12 is provided on metal substrate 11, and monopole antenna 22*c* is directly connected to this feeding point 12. The dimensions of metal substrate 11, monopole antenna 22*c* and helical antenna 22*a* are similar to those of the antenna element from which the data of Table 1 was obtained. Waves from 1.5 GHz to 2.5 GHz in frequency were caused to be incident upon an antenna element 20*z* of the portable telephone 1*z* from feeding point 12 to obtain the impedance property (Smith chart and VSWR) of antenna element 20*z*. The impedance and VSWR for particular points are shown in Table 2.

TABLE 2

| | | Impedance of Antenna Element (Ω) | | |
|---|---|---|---|---|
| Point | Frequency (GHz) | Real Part (Ω) | Imaginary Part (Ω) | VSWR |
| 111 | 1.92 | 51.0 | −136.5 | 9.2 |
| 112 | 1.98 | 35.0 | 113.2 | 9.3 |
| 113 | 2.11 | 29.1 | −112.7 | 11.2 |
| 114 | 2.17 | 21.7 | −109.8 | 13.8 |

Figure 14:
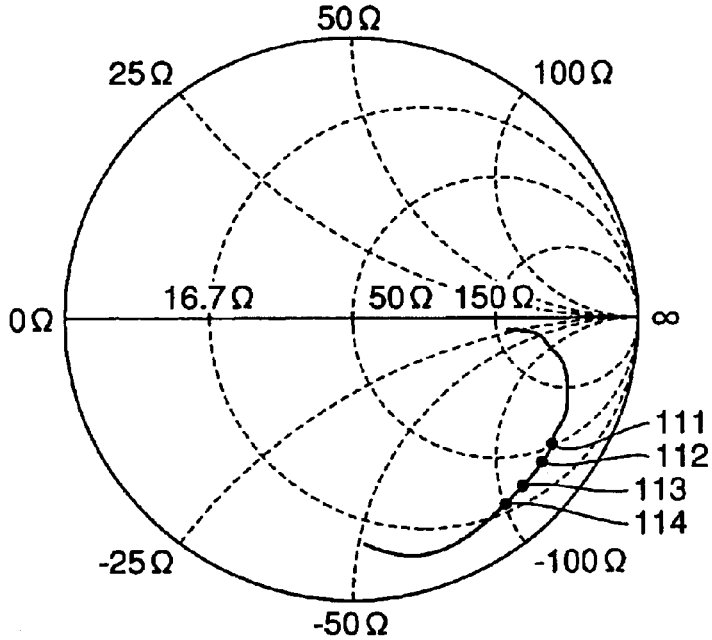
FIG. 14 PRIOR ART
FIG. 14 is a Smith chart to describe the property of a conventional antenna element.
Figure 15:
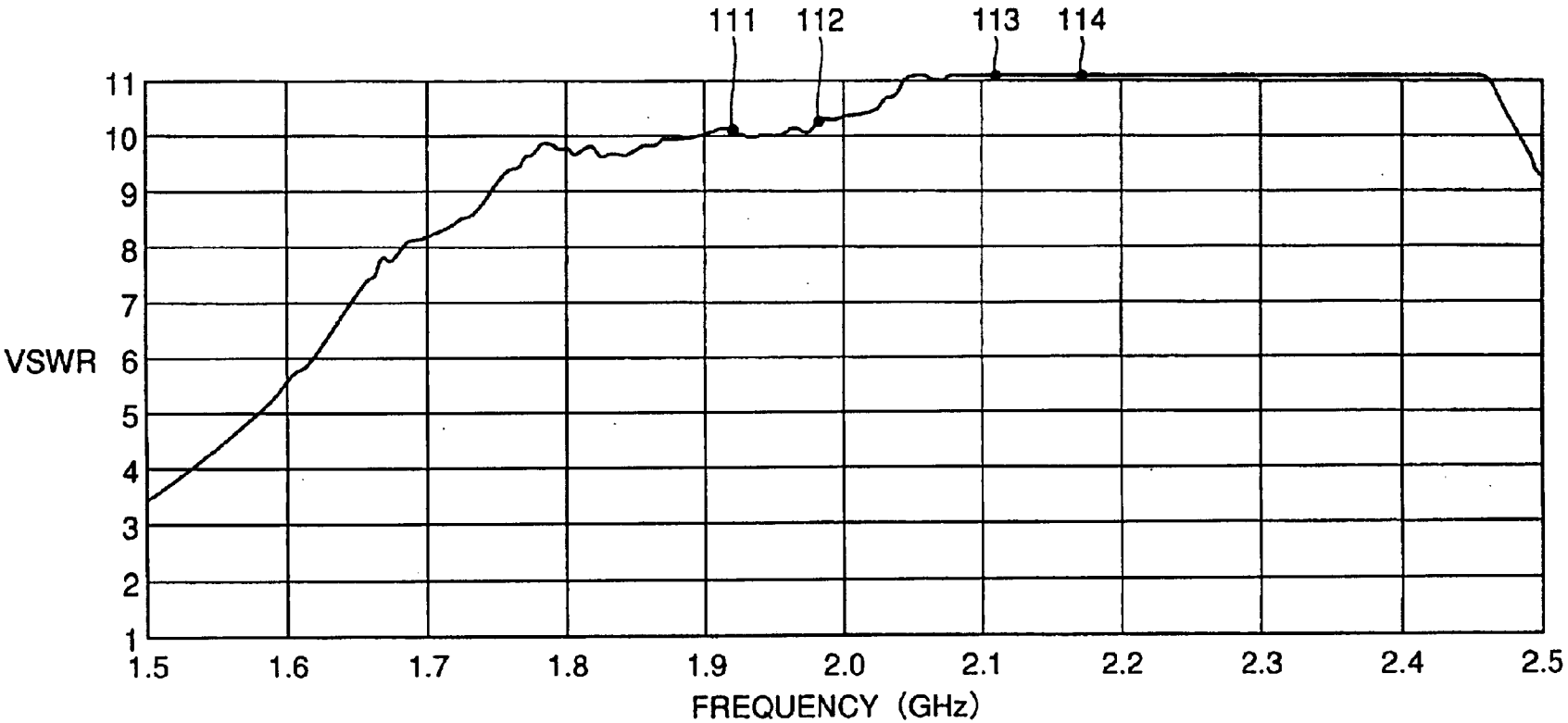
FIG. 15 PRIOR ART
FIG. 15 is a graph indicating the relationship between the frequency and VSWR of the conventional antenna element.

The Smith chart is shown in FIG. 14. The relationship between the VSWR and frequency is shown in FIG. 15.

It is appreciated from FIG. 14 that, according to the conventional antenna element, the locus of the impedance is remote from the center point of the Smith chart, and the reflection coefficient is great at substantially all the regions. It is to be noted that the reflection coefficient is particularly great-at the region of high frequency. It is to be also appreciated from FIG. 15 that there is no region where the VSWR is below 2.

Thus, there will be no bandwidth that can be used for information communication by a conventional antenna element if the matching circuit is removed.

Figure 16:
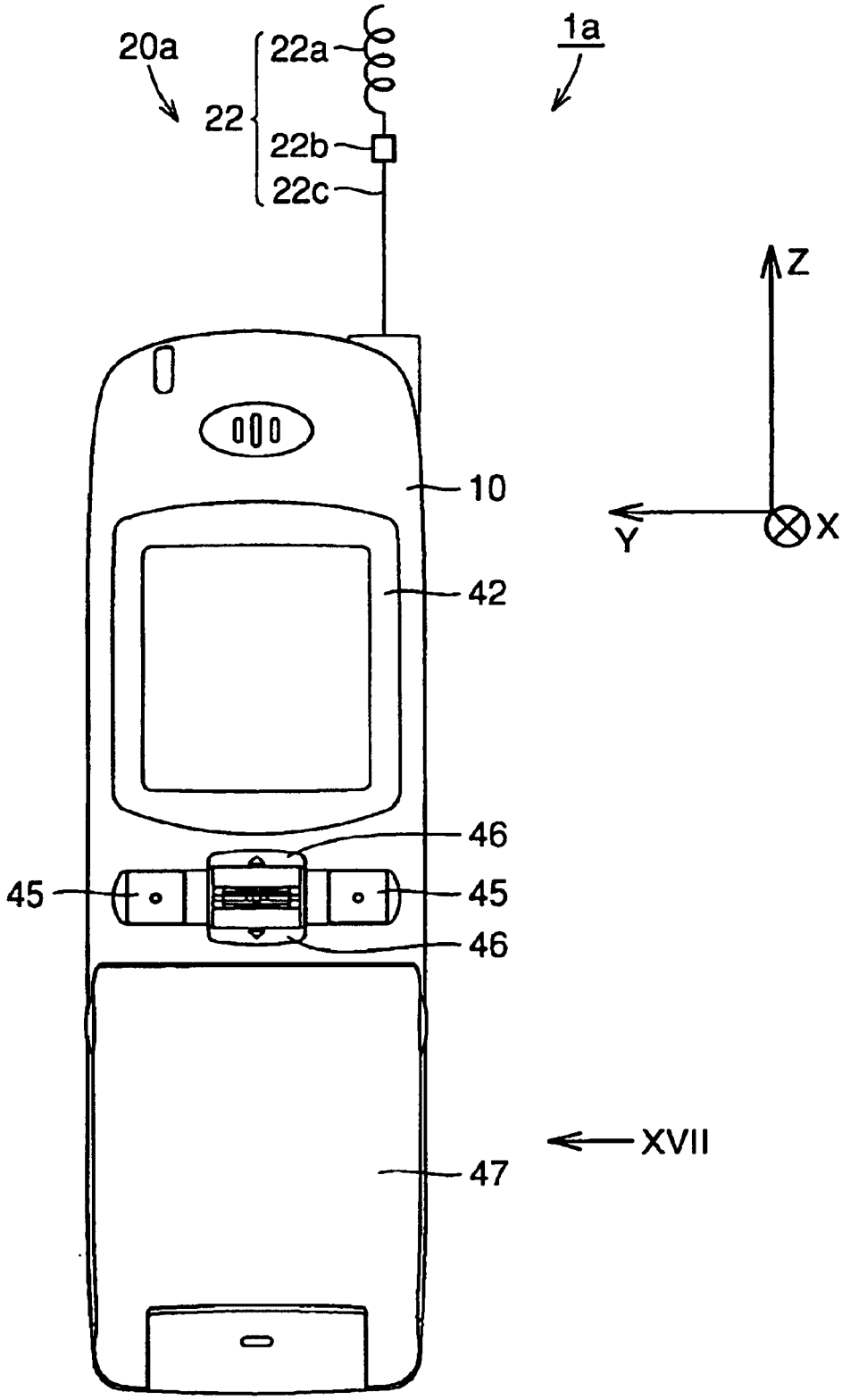
FIG. 16 is a plan view of a portable telephone to describe the relationship between the portable telephone of the present invention and the X, Y and Z axes.

The radiation characteristics between the antenna element of the present invention and the conventional antenna element were compared. FIG. 16 is a plan view of a portable telephone to describe the relationship between the portable telephone of the present invention and the axes of X, Y and Z. A portable telephone 1*a* of the present invention was prepared as shown in FIG. 16. Portable telephone 1*a* includes a main unit case 10. A protection window 42 is provided at the surface of main unit case 10. A liquid crystal panel is disposed behind protection window 42. A multi-function switch 46 and an operation key 45 are provided at the center area of main unit case 10. A flip 47 is provided at the lower portion of main unit case 10.

Second antenna unit 22 is provided so as to project from the leading end of main unit case 10. Second antenna unit 22 is formed of helical antenna 22*a*, insulator 22*b* and monopole antenna 22*c*. Antenna element 20*a* is provided in main unit case 10. Second antenna unit 22 constituting antenna unit 20*a* is provided projecting from main unit case 10. Second antenna unit 22 is formed of helical antenna 22*a*, insulator 22*b* and monopole antenna 22*c*. Antenna element 20*a* is formed likewise antenna element 20*a* shown in FIG. 1, including metal substrate 11, feeding point 12 and meander line antenna 21 provided in main unit case 10.

The extending direction of second antenna unit 22 is the +Z direction. The direction from right to left in FIG. 16 is the +Y direction. The direction at right angles to the paper plane of FIG. 16 towards the rear is the +X direction.

Figure 17:
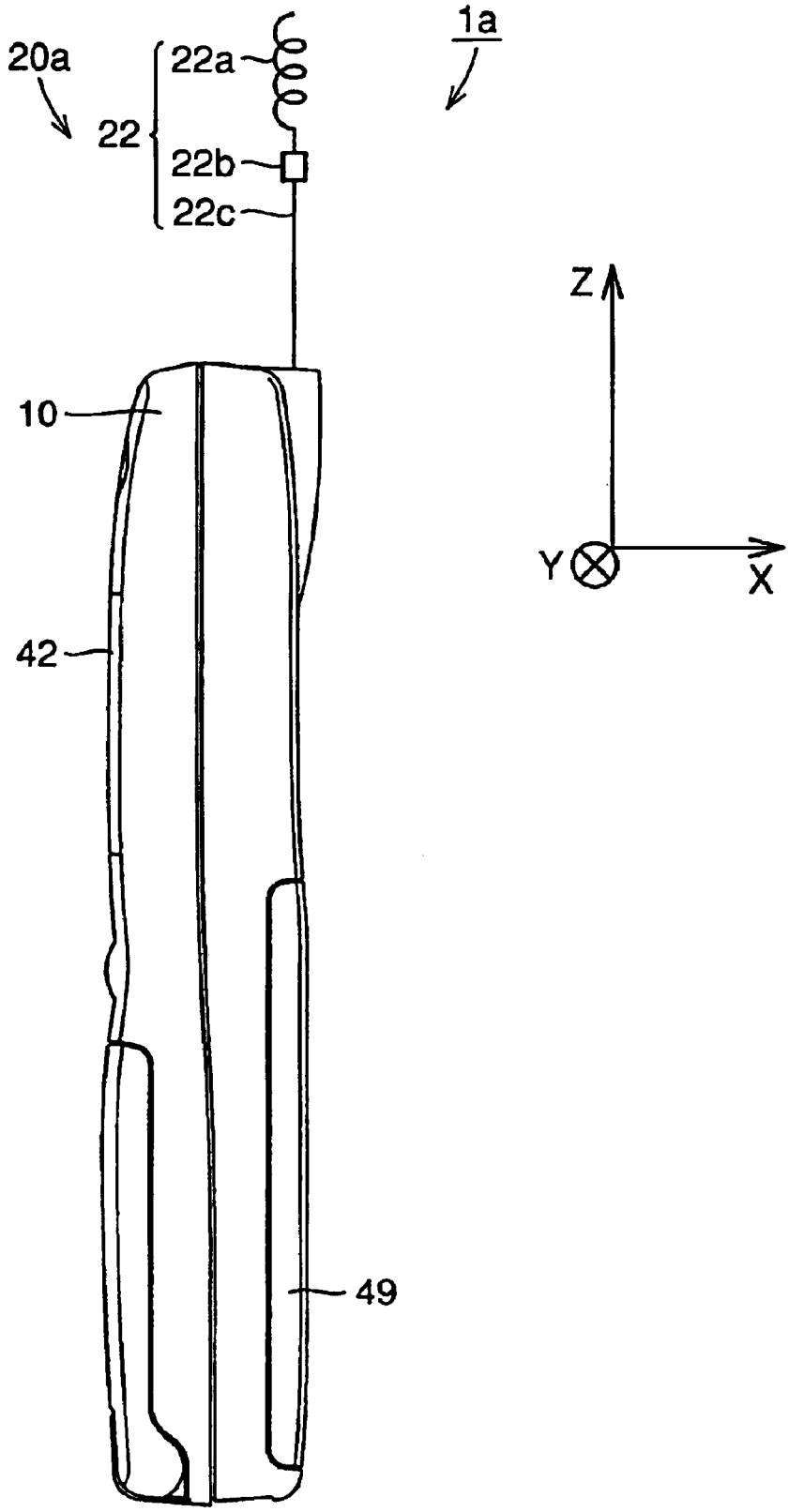
FIG. 17 is a side view of a portable telephone when viewed from the direction indicated by arrow XVII in FIG. 16.

FIG. 17 is a side view of the portable telephone when viewed from the direction indicated by arrow XVII in FIG. 16. Referring to FIG. 17, a battery 49 is attached to main case 10 of portable telephone 1*a*. Protection window 42 corresponding to a liquid crystal panel display is mounted at the front face of main unit case 10 whereas battery 49 is mounted at the back face of main unit case 10. The direction from battery 49 towards second antenna unit 22 is the +Z direction. The direction from protection window 42 to the back face of main unit case 10 is the +X direction. The direction at right angles to the paper plane of FIG. 17 towards the rear is the +Y direction.

Figure 18:
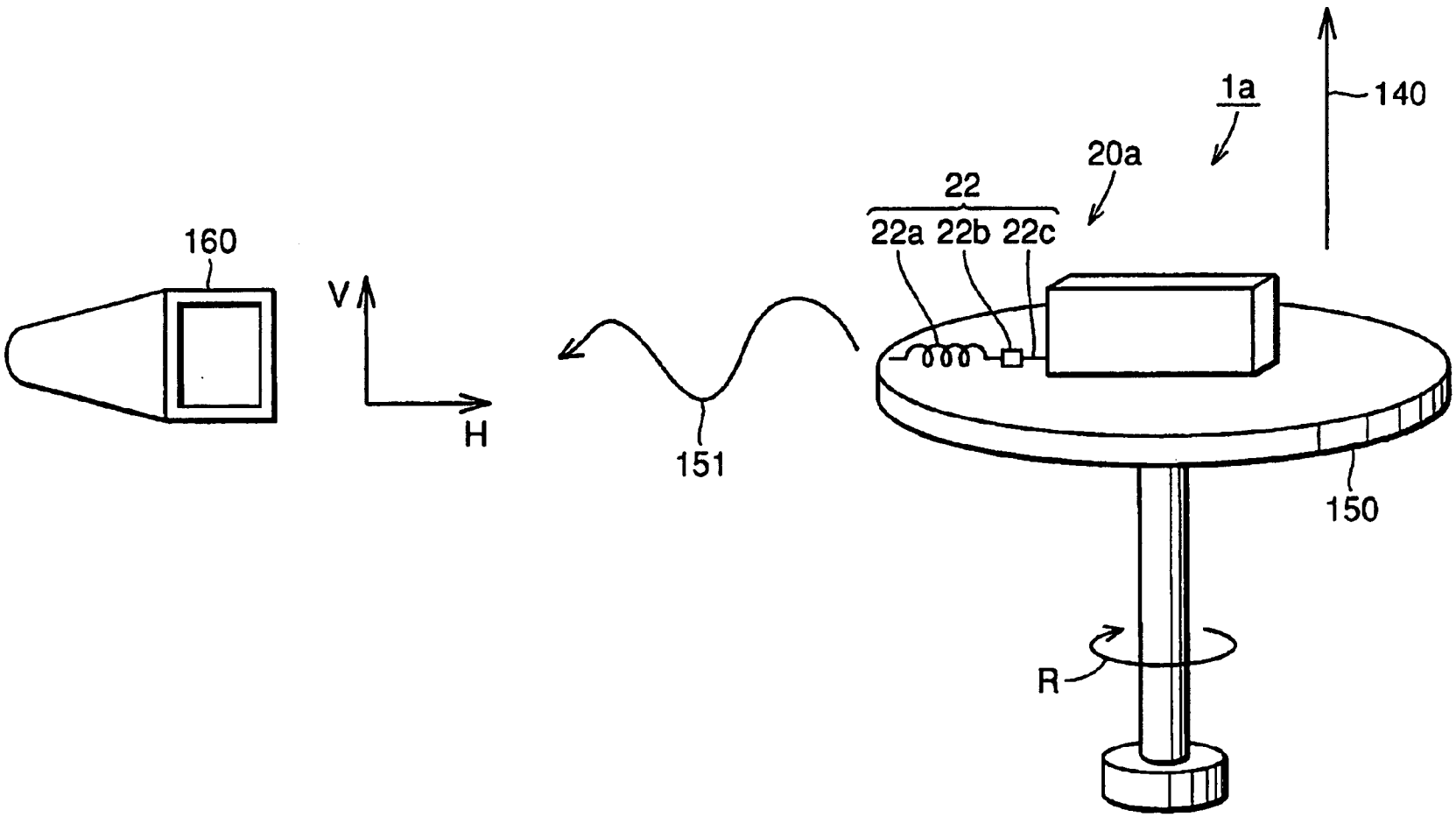
FIG. 18 is a diagram showing the process of measuring the radiation pattern at the X-Z plane.
Figure 19:
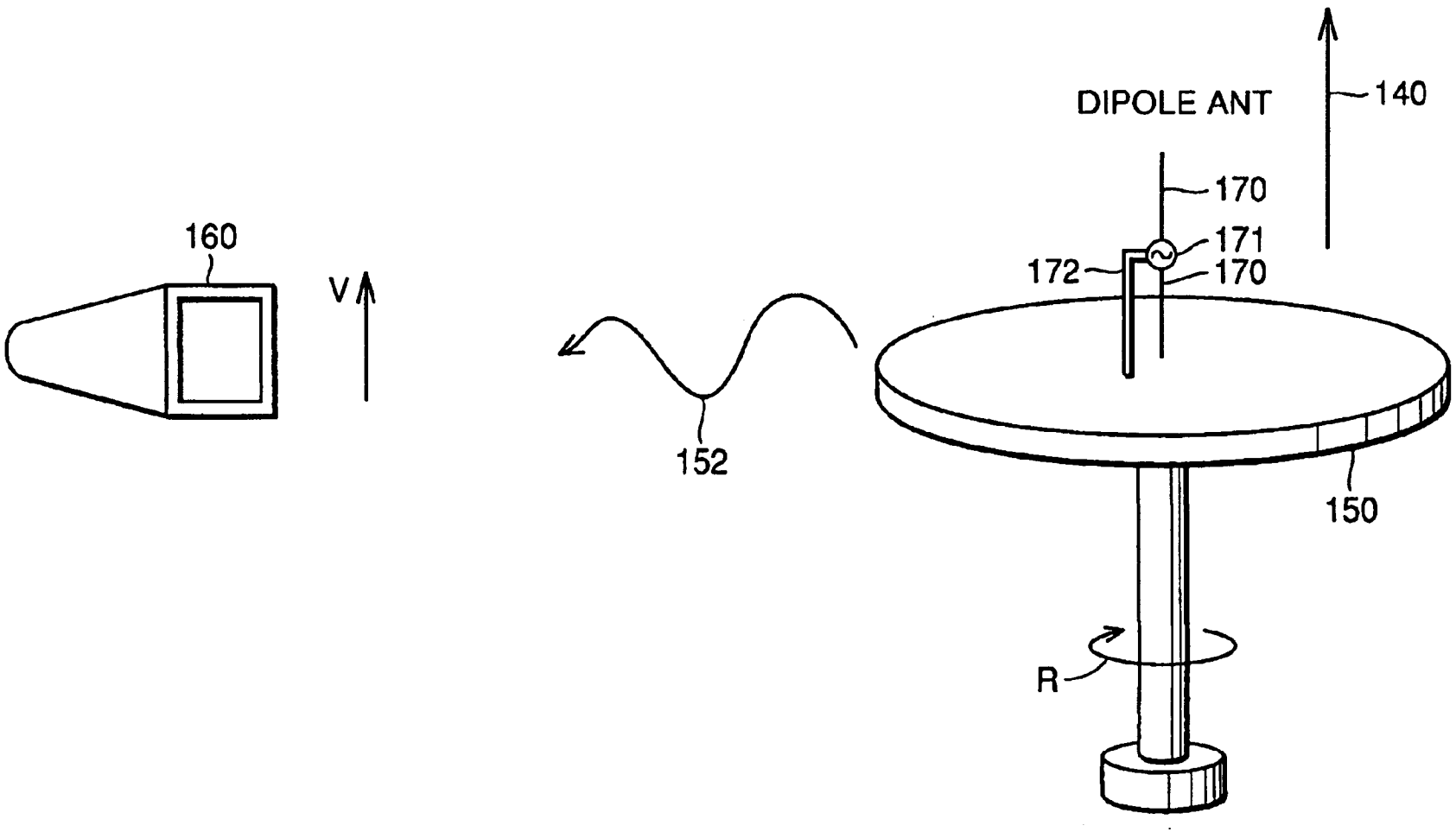
FIG. 19 is a diagram showing the process of measuring the radiation pattern at the X-Z plane.
Figure 20:
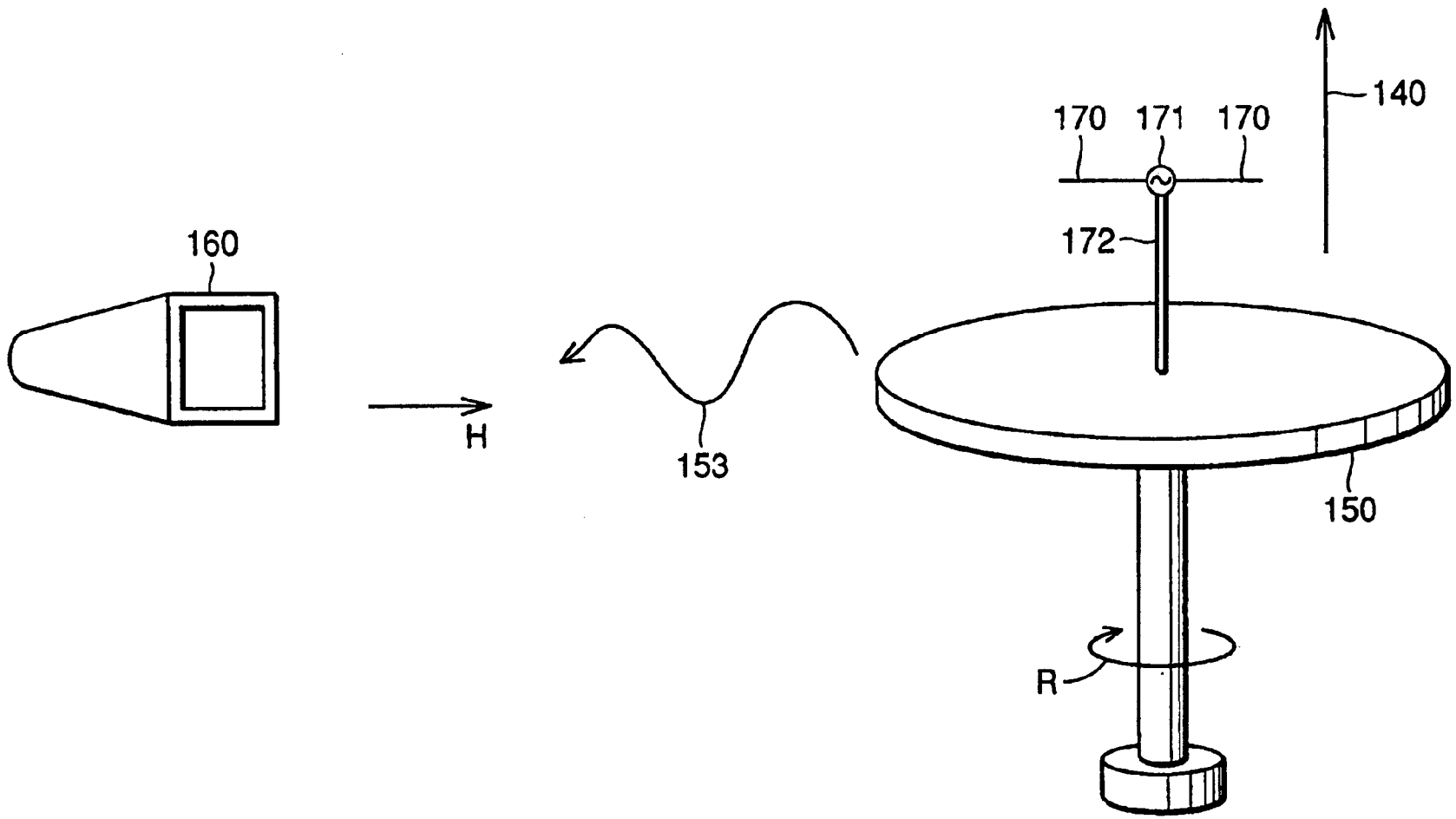
FIG. 20 is a diagram showing the process of measuring the radiation pattern at the X-Z plane.

FIGS. 18–20 show the process of measuring the radiation pattern at the X-Z plane. Referring to FIG. 18, portable telephone 1*a* of FIGS. 16 and 17 was placed on a table 150. Here, portable telephone 1*a* was placed so that the extending direction of second antenna unit 22, i.e., the directions of +Z and +X, is substantially orthogonal to the perpendicular direction indicated by arrow 140. Accordingly, the +Y direction is substantially parallel to the perpendicular direction indicated by arrow 140. Table 150 is rotatable in a direction indicated by arrow R.

With portable telephone 1*a* placed on table 150 as described above, a wave of 1.95 GHz in frequency was radiated via antenna element 20*a* in response to a predetermined output from the radio transmitter-receiver. At the current stage, table 150 was rotated in the direction indicated by arrow R. As a result, a wave as shown by arrow 151 was emitted from antenna unit 20*a*. The electric field intensity of this wave was measured using a measurement-oriented antenna 160. The electric field intensity of the vertically polarized wave in the direction indicated by arrow V and the horizontally polarized wave in the direction indicated by arrow H was obtained.

Referring to FIG. 19, a dipole antenna 170 was placed on table 150. Dipole antenna 170 has a feeding point 171 provided at the center portion thereof to which a coaxial cable 172 is connected. Coaxial cable 172 is connected to a predetermined radio transmitter-receiver. Dipole antenna 170 extends in a direction substantially parallel to the perpendicular direction indicated by arrow 140. An output identical to that applied by the radio transmitter-receiver to antenna element 20*a* of FIG. 18 was supplied to dipole antenna 170 with table 150 rotated in the direction indicated by arrow R. A wave of 1.95 GHz in frequency indicated by arrow 152 was radiated from dipole antenna 170. Thus, a wave indicated by arrow 152 was radiated from dipole antenna 170. This wave is a vertically polarized wave in the direction indicated by arrow V. The electric field intensity of this wave was measured by measurement-oriented antenna 160.

Referring to FIG. 20, dipole antenna 170 was placed on table 150. Dipole antenna 170 was disposed so as to extend substantially orthogonal to the perpendicular direction indicated by arrow 140. Feeding point 170 is provided at the center of dipole antenna 170. Feeding point 171 is connected to a coaxial cable 172. An output identical to that applied to antenna element 20*a* of FIG. 18 by a radio transmitter-receiver was applied to dipole antenna 170 with table 150 rotated in the direction indicated by arrow R, whereby a wave of 1.95 GHz in frequency indicated by arrow 153 was radiated from dipole antenna 170. This wave is a horizontally polarized wave in the direction indicated by arrow H. The electric field intensity of this wave was obtained by measurement-oriented antenna 160.

The radiation pattern of the antenna element of the present invention was obtained based on the data obtained by the processes shown in FIGS. 18–20. The result is shown in FIG. 21.

Figure 21:
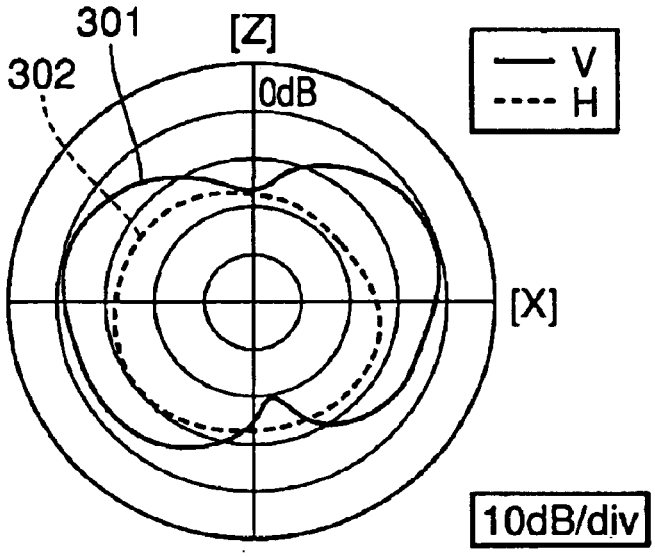
FIG. 21 is a graph showing the radiation pattern at the X-Z plane for the present invention.

In FIG. 21, the solid line 301 indicates the gain of the vertical polarization component of the wave radiated from antenna element 20*a* of FIG. 18 with respect to the electric field intensity of the vertically polarized wave emitted from dipole antenna 170 in the process shown in FIG. 19. The gain was calculated according to the following equation.

(Gain)=20×$\log_{10}$ (electric field intensity of vertically polarized wave from antenna element 20*a*/electric field intensity of vertically polarized wave from dipole antenna 170).

The dotted line 302 indicates the gain of the horizontal polarization of the wave emitted from antenna element 20*a* of FIG. 18 with respect to the electric field intensity of a horizontally polarized wave emitted from dipole antenna 170 in the process shown in FIG. 20. The gain is calculated according to the following equation.

(Gain)=20×$\log_{10}$ (electric field intensity of horizontally polarized wave from antenna 20*a*/electric field intensity of horizontally polarized wave from dipole antenna 170)

It is appreciated from FIG. 21 that the gain of vertical polarization is greater than the gain of horizontal polarization in antenna element 20*a* of the present invention. In FIGS. 21–24, one scale mark indicates 10 dB. The point on the X axis which is the horizontal axis in FIG. 21 corresponds to the point of the gain under the state where the X axis shown in FIGS. 16 and 17 is towards the direction of measurement-oriented antenna 160. The point on the Z axis which is the vertical axis in FIG. 21 is the point indicating the gain under the state where the Z axis shown in FIGS. 16 and 17 is towards the direction of measurement-oriented antenna 160.

The gains of the vertically and horizontally polarized waves (XPR (cross polarization ratio)=6 dB) were averaged to obtain the average gain. The average gain was −4.56 dBd. The peak value of gain was −0.86 dBd.

In the process of FIG. 18, portable telephone 1*a* was placed on table 150 so that the Z axis (the extending direction of second antenna unit 22) is at an angle of approximately 60° with the perpendicular direction indicated by arrow 140. Under this state, a predetermined output was applied to antenna element 20*a* from a radio transmitter-receiver while table 150 shown in FIG. 18 is rotated in the direction of arrow R, whereby a wave was radiated. When one communicates using a portable telephone, i.e., in the operation of depressing a button of the portable telephone, the angle between the extending direction of the antenna and the perpendicular direction is generally approximately 60°. Under this state, an output similar to that of the process of FIG. 18 was applied to antenna element 20*a* from a radio transmitter-receiver while table 150 is rotated in the direction indicated by R, whereby a wave of 1.95 GHz in frequency was radiated. The electrical field intensity of the vertical polarization component and horizontal polarization component of this wave was measured with measurement-oriented antenna 160.

Figure 22:
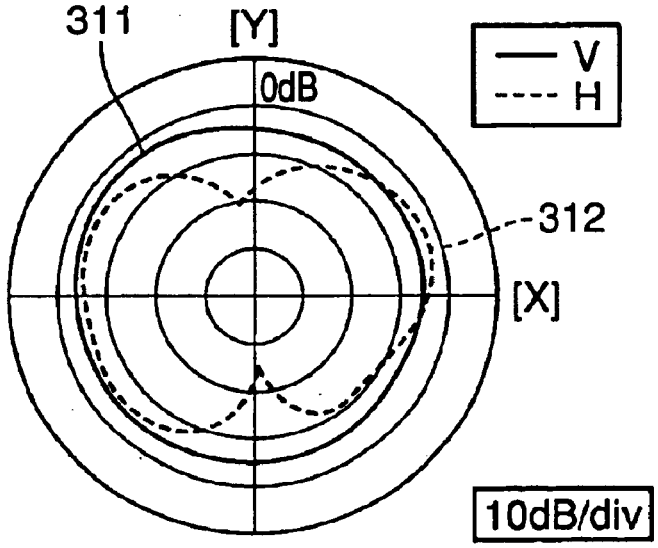
FIG. 22 is a graph showing the radiation pattern in a state where the Z axis of the present invention is tilted 60° with respect to the perpendicular direction.

The radiation pattern corresponding to the state where the Z axis is arranged 60° tilted from the perpendicular direction is shown in FIG. 22. In FIG. 22, the solid line 311 indicates the gain of the intensity of the vertical polarization component of the wave emitted from antenna element 20*a* having the Z axis tilted 60° to the perpendicular direction with respect to the electrical field intensity of the vertically polarized wave measured by the process of FIG. 19. The gain is calculated based on the following equation.

(Gain)=20×$\log_{10}$ (electric field intensity of vertically polarized wave from antenna element 20*a* tilted 60°/electric field intensity of vertically polarized wave from dipole antenna 170)

The dotted line 312 indicates the gain of the electric field intensity of the horizontal polarization component of the wave radiated from antenna 20*a* having the Z axis tilted 600 to the perpendicular direction with respect to the intensity of the horizontally polarized wave measured in the process of FIG. 20. This gain is calculated according to the following equation.

(Gain)=20×$\log_{10}$ (electric field intensity of horizontally polarized wave from antenna element 20*a* tilted 60°/electric field intensity of horizontally polarized wave from dipole antenna 170)

It is appreciated from FIG. 22 that the gain of the vertically and horizontally polarized waves when the Z axis of the antenna element is tilted 60° with respect to the perpendicular direction, i.e. when in a normal conversation state of the portable telephone, is increased. The average gain (XPR=6 dB) of the vertical polarization component and horizontal polarization component was obtained from FIG. 22. The average gain was −4.27 dBd, which is a favorable value. The peak value of gain was −2.82 dBd.

It is therefore appreciated that the conversation gain is increased in whatever state the portable telephone of the present invention is held.

Figure 23:
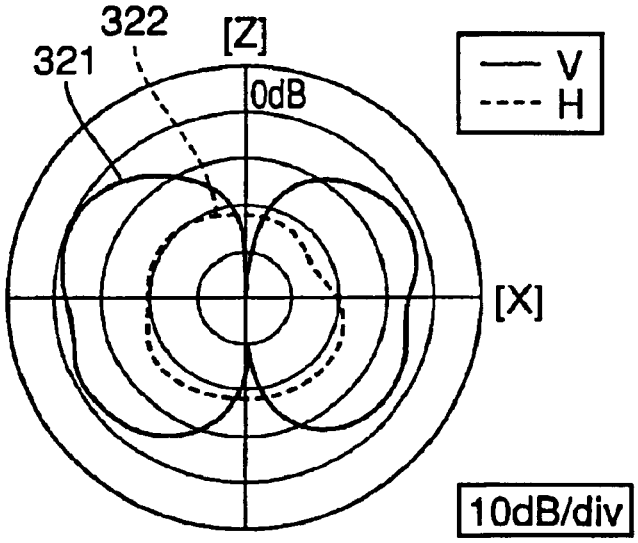
FIG.23 PRIOR ART
FIG. 23 is a graph showing the radiation pattern at the X-Z plane for a conventional portable telephone.

Portable telephone 1*z* with the conventional antenna element 20*z* shown in FIG. 13 was placed on table 150 under a state where the Z axis and X axis are in the horizontal direction and the Y axis is parallel to the perpendicular direction, according to a process similar to that shown in FIG. 18. Under this state, a wave of 1.95 GHz in frequency was radiated via antenna 20*z* with table 150 rotated in the direction indicated by arrow R. Here, an output identical to the output applied by the radio transmitter-receiver to antenna element 20*a* was applied to antenna element 20*z*. The vertical polarization component and horizontal polarization component of the radiated wave were measured using measurement-oriented antenna 160. The radiation pattern for such a conventional antenna is shown in FIG. 23. In FIG. 23, the solid line 321 indicates the gain of the electric field intensity of the vertical polarization component of the wave radiated from antenna element 20*z* according to the process of FIG. 18 with respect to the electric field intensity of the vertically polarized wave measured in the process of FIG. 19. This gain is calculated according to the following equation.

(Gain)=20×$\log_{10}$ (electric field intensity of vertically polarized wave from antenna element 20*z*/electric field intensity of vertically polarized wave from dipole antenna 170)

The dotted line 322 indicates the gain of the electric field intensity of the horizontal polarization component of the wave radiated from antenna element 20*z* according to the process of FIG. 18 with respect to the electric field intensity of the horizontally polarized wave measured in the process of FIG. 20. This gain is calculated according to the following equation.

(Gain)=20×$\log_{10}$ (electric field intensity of horizontally polarized wave from antenna element 20z/electric field intensity of horizontally polarized wave from dipole antenna 170)

It is appreciated from FIG. 23 that the gain of both the horizontal polarization component and vertical polarization component is reduced. The average gain obtained from FIG. 23 was −4.74 dBd. The peak value of gain was −1.13 dBd.

Portable telephone 1z was placed on table 150 so that the Z axis (the extending direction of helical antenna 22*a* and monopole antenna 22*c*) of portable telephone 1z on table 150 is at an angle of approximately 60° with the perpendicular direction indicated by arrow 140. Under this state, a wave of 1.95 GHz in frequency was radiated from antenna element 20z by a predetermined output with table 150 rotated in the direction indicated by arrow R. The electric field intensity of the vertical polarization component and horizontal polarization component of this wave was measured using measurement-oriented antenna 160. The radiation pattern of an antenna element arranged so that the Z axis is angled 60° with the perpendicular direction is shown in FIG. 24.

Figure 24:
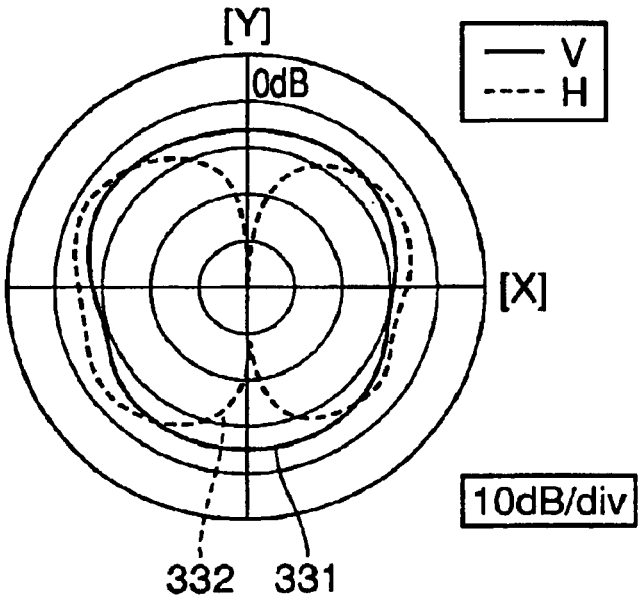
FIG.24 PRIOR ART
FIG. 24 is a graph showing the radiation pattern in a state where the Z axis of a conventional portable telephone is tilted 60° with respect to the perpendicular direction.

In FIG. 24, the solid line 331 indicates the gain of the electric field intensity of the wave emitted from antenna element 20z that has the Z axis tilted 60° to the perpendicular direction with respect to the electric field intensity of a vertically polarized wave measured by the process shown in FIG. 19. This gain is calculated according to the following equation.

(Gain)=20×$\log_{10}$ (electric field intensity of vertically polarized wave from antenna element 20z tilted 60°/electric field intensity of vertically polarized wave from dipole antenna 170)

The dotted line 332 indicates the gain of the electric field intensity of the horizontal polarization component of the wave radiated from antenna element 20z having the Z axis tilted 60° to the perpendicular direction with respect to the electric field intensity of the horizontally polarized wave measured according to the process of FIG. 20. This gain is calculated according to the following equation.

(Gain)=20×$\log_{10}$ (electric field intensity of horizontally polarized wave from antenna element 20z tilted 60°/electric field intensity of horizontally polarized wave from dipole antenna 170)

It is appreciated from FIG. 24 that the gain of both vertically polarized wave and horizontally polarized wave of the conventional product is smaller than that of the product of the present invention. The average gain obtained from FIG. 24 was −5.64 dBd. The peak value of gain was −3.04 dBd.

Since a matching circuit is not provided in the antenna element according to the present invention, the gain in conversation can be improved as to the transmission/reception of both the components of a horizontally polarized wave and vertically polarized wave in addition to reducing a loss caused by the matching circuit.

INDUSTRIAL APPLICABILITY

The antenna element of the present invention is applicable to the field of portable information terminals such as portable telephones, and personal computers having communication capability, general radios, particular radios and the like.

What is claimed is:

1. An antenna element comprising:

a first antenna unit formed so as to extend in one direction;

a second antenna unit (λ/2) extending substantially orthogonal to the extending direction of said first antenna unit, having an electrical length of substantially (λ/2)×A (A is an integer), and coupled to said first antenna unit; and a feeding point connected to one end of the first antenna unit, the other end of the first antenna unit being connected to the second antenna unit, wherein said first antenna unit and said second antenna unit are attached in consecutive order to the feeding point.

2. The antenna element according to claim 1, wherein said first antenna unit has an electrical length of approximately (λ/4)+(λ/2)×B (B is an integer).

3. The antenna element according to claim 1, wherein said first antenna unit includes at least one type of antenna selected from the group consisting of a plate antenna, a monopole antenna, a helical antenna, a meander line antenna and a zigzag antenna.

4. The antenna element according to claim 1, wherein said second antenna unit includes a line antenna.

5. The antenna element according to claim 4, wherein said line antenna includes at least one type of antenna selected from the group consisting of a monopole antenna and a helical antenna.

6. The antenna element according to claim 1, further comprising a substrate with a conductive surface, said first antenna unit being provided on the surface of said substrate with a dielectric therebetween, and said second antenna unit being provided so as to extend from said substrate.

7. A portable information terminal comprising:

a main unit case; and an antenna element including a first antenna unit arranged within said main unit case, and formed to extend in one direction, and a second antenna unit extending substantially orthogonal to the extending direction of said first antenna unit, and arranged projectable from said main unit case, having an electrical length of approximately (λ/2)×A (A is an integer), and coupled to said first antenna unit; and a feeding point connected to one end of the first antenna unit, the other end of the first antenna unit being connected to the second antenna unit, wherein said first antenna unit and said second antenna unit are attached in consecutive order to the feeding point.

8. The portable information terminal according to claim 7, wherein said second antenna unit comprises a third antenna unit having an electrical length of approximately (λ/2)×C (C is an integer), and a fourth antenna unit coupled to said third antenna unit, and having an electrical length of approximately (λ/2)×D (D is an integer), said third and said fourth antenna units projecting from said main unit case when said antenna element is pulled out from said main unit case, and said third antenna unit projecting from said main unit case and said fourth antenna unit located in said main unit case when said antenna element is stored in said main unit case.

* * * * *